US008336994B2

(12) United States Patent
Sugahara

(10) Patent No.: US 8,336,994 B2
(45) Date of Patent: Dec. 25, 2012

(54) DROPLET EJECTION DEVICE AND MANUFACTURING METHOD THEREOF

(75) Inventor: Hiroto Sugahara, Aichi-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 477 days.

(21) Appl. No.: 12/626,247

(22) Filed: Nov. 25, 2009

(65) Prior Publication Data

US 2010/0134561 A1 Jun. 3, 2010

(30) Foreign Application Priority Data

Nov. 28, 2008 (JP) ..... 2008-304571

(51) Int. Cl.
*B41J 2/14* (2006.01)
*B41J 2/16* (2006.01)

(52) U.S. Cl. ..... 347/47; 347/65

(58) Field of Classification Search ..... 347/20, 347/37, 44–47, 67, 71, 72
See application file for complete search history.

(56) References Cited

U.S. PATENT DOCUMENTS 7,757,398 B2 * 7/2010 Hori ..... 29/890.1
2006/0221161 A1 10/2006 Hori
2006/0268074 A1 11/2006 Hori

FOREIGN PATENT DOCUMENTS

JP H04-353459 A 12/1992
JP H07-117229 A 5/1995
JP H08-323986 A 12/1996
JP H10-175341 A 6/1998
JP 2002-211055 A 7/2002
JP 2002-248775 A 9/2002
JP 2006-281542 A 10/2006
JP 2006-327108 A 12/2006

OTHER PUBLICATIONS

Japan Patent Office; Notice of Reasons for Rejection in Japanese Patent Application No. 2008-304571 mailed on Aug. 17, 2010.

* cited by examiner

*Primary Examiner* — Thinh Nguyen
(74) *Attorney, Agent, or Firm* — Baker Botts L.L.P.

(57) ABSTRACT

A droplet ejection device includes a first member and a second member. The first member includes a droplet ejection surface which has a plurality of nozzles opening thereon and a flat bonding surface which lies opposite to the droplet ejection surface. The droplet ejection surface is curved corresponding to a curved surface onto which the nozzles ejecting droplets. The second member is bonded to the bonding surface of the first member.

9 Claims, 10 Drawing Sheets

DROPLET EJECTION DEVICE AND MANUFACTURING METHOD THEREOF

CROSS REFERENCE TO RELATED APPLICATION

This application claims priority from Japanese Patent Application No. 2008-304571, which was filed on Nov. 28, 2008, the disclosure of which is herein incorporated by reference in its entirety.

BACKGROUND OF THE INVENTION

1. Field of the Invention

The present invention relates to a droplet ejection device which ejects droplets onto a curved surface, and to a manufacturing method of the device.

2. Description of Related Art

As an example of a droplet ejection device which ejects droplets onto a curved surface, there has been known an ink-jet head disposed so as to face a cylindrical drum which holds a printing medium on its surface. A printing medium, which is held on the surface of the drum in a curved state, is conveyed as the drum rotates. Ink droplets are ejected from nozzles of the head to a printing surface of the printing medium, that is, an opposite surface of a surface of the printing medium facing the surface of the drum, and thereby printing is conducted. In this type of head, while the printing surface of a printing medium is curved corresponding to the curved surface of the drum, a droplet ejection surface of the head, on which a plurality of nozzles open, is flat. Because of this, the distance between the droplet ejection surface and the printing surface of the printing medium is not constant. This causes a problem of a deviation of ink landing position, that is, ink is not landed at a position where it should be landed, on the printing surface of the printing medium during printing.

In order to solve the above problem, it is preferable that the droplet ejection surface is parallel to the printing surface of a printing medium. For example, a head may be configured to be curved as a whole, the head including: a nozzle plate in which a plurality of nozzles are formed; a substrate in which pressure chambers respectively corresponding to the nozzles are formed; a diaphragm bonded to the substrate; and piezoelectric elements provided on the diaphragm so that the piezoelectric elements respectively correspond to the pressure chambers. As a result, the droplet ejection surface of the nozzle plate is configured to be curved.

SUMMARY OF THE INVENTION

In the case where the head is configured to be curved as a whole as described above, in assembling the head, each of the members (i.e., the nozzle plate, the substrate, the diaphragm, and the piezoelectric elements) is bent, and then these are stacked on top of one another and bonded to one another. However, this causes another problem. That is, compared to the case of flat members, it is difficult to exert a force uniformly to bonding surfaces between these curved members, resulting in unreliable bonding. Particularly, it is hard to bend fragile members such as a piezoelectric element and the like, and a crack possibly occurs therein due to locally concentrated stress at the time of bonding.

An object of the present invention is to provide: a droplet ejection device capable of preventing a deviation of the landing position of a droplet ejected onto a curved surface and simultaneously achieving easy and reliable bonding between members constituting the device; and a manufacturing method of the device.

According to a first aspect of the present invention, provided is a droplet ejection device comprises a first member and a second member. The first member includes a droplet ejection surface which has a plurality of nozzles opening thereon and a flat bonding surface which lies opposite to the droplet ejection surface. The droplet ejection surface is curved corresponding to a curved surface onto which the nozzles ejecting droplets. The second member is bonded to the bonding surface of the first member.

According to a second aspect of the present invention, provided is a manufacturing method of a droplet ejection device, comprising: a step of producing a first member including a droplet ejection surface which has a plurality of nozzles opening thereon, a step of producing a second member which is to be bonded to the first member; and a step of bonding the second member to the first member. The step of producing the first member includes forming the droplet ejection surface so that the droplet ejection surface is curved corresponding to a curved surface onto which the nozzles ejecting droplets and forming a flat bonding surface opposite to the droplet ejection surface. In the step of bonding, the second member is bonded to the bonding surface of the first member.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

The following describes a preferred embodiment of the present invention, with reference to drawings.

Figure 1:
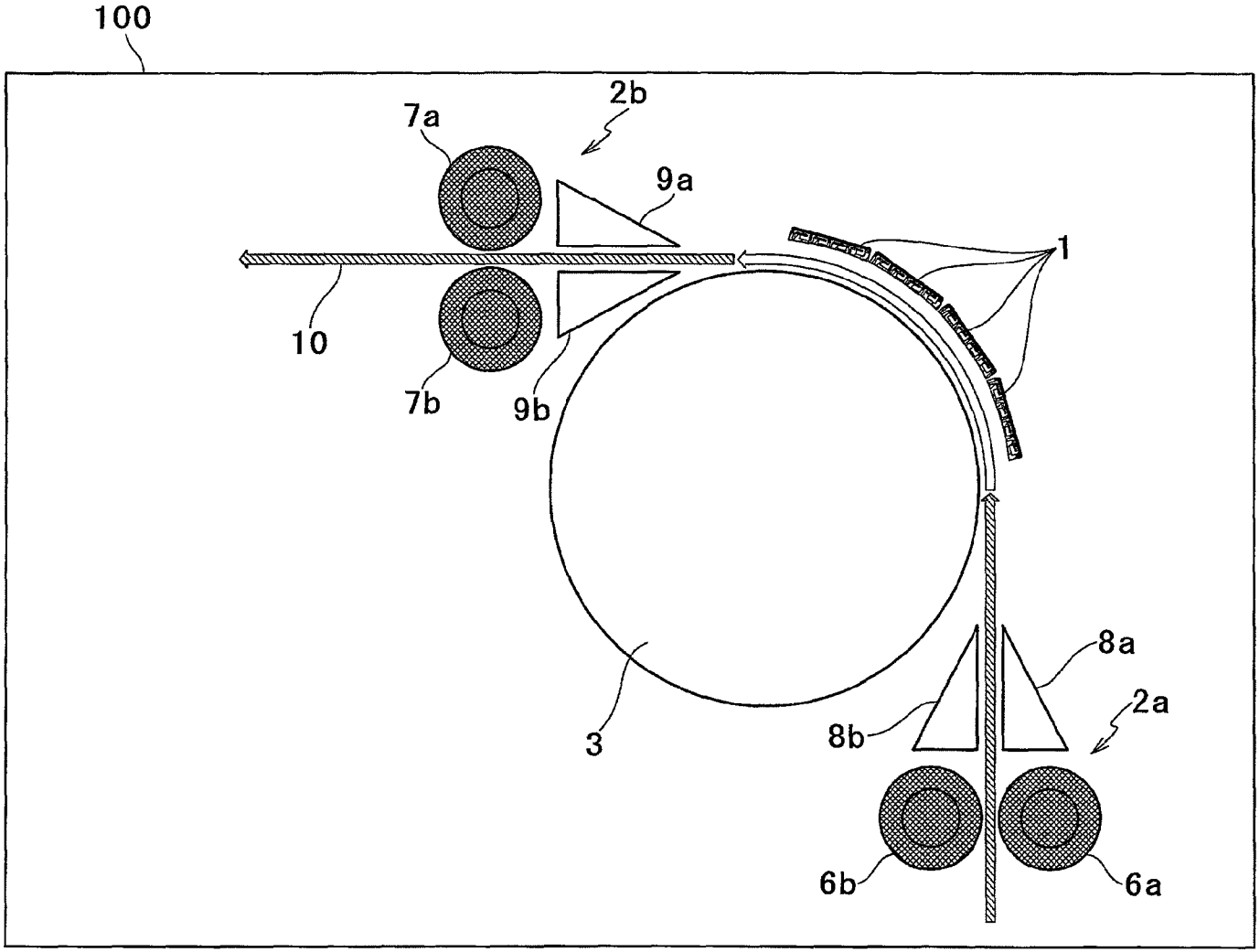
FIG. 1 is a schematic diagram of a printer which includes ink-jet heads of a first embodiment of the present invention.

First, referring to FIG. 1, described is a schematic structure of a printer 100 including ink-jet heads 1 of a first embodiment of the present invention. The printer 100 has: four line-type heads 1; conveyor mechanisms 2*a* and 2*b*; a conveyor drum 3; and the like.

Inside the printer 100, a sheet is conveyed along a conveyance path 10. The sheet is sent by the conveyor mechanism 2*a* to the drum 3. While the sheet is retained and conveyed by the drum 3, ink droplets ejected from the four heads 1 are landed on a surface of the sheet, and thereby text or an image is printed thereon. The sheet having received printing thereon is discharged by the conveyor mechanism 2*b* to the outside of the printer 100. Hereinafter, specific structure of each component of the printer 100 will be described.

The four heads 1 each extending in a direction of an axis of the drum 3 and facing the drum 3 are arranged along the conveyance path 10. The longitudinal length of each head 1 is substantially equal to the width of the drum 3. The four heads 1 respectively eject four colors of ink, which are yellow, magenta, cyan, and black, onto a sheet conveyed between a surface of the drum 3 and the under surfaces of the heads 1.

The conveyor mechanism 2*a* includes: two cylindrical first conveyance rollers 6*a* and 6*b* facing each other with the conveyance path 10 interposed therebetween; and two guides 8*a* and 8*b* which are provided between the first conveyance rollers 6*a* and 6*b* and the drum 3 to guide a sheet. As the first conveyance roller 6*b* is driven by a not-shown motor, a sheet gripped between the first conveyance rollers 6*a* and 6*b* is conveyed to the drum 3 while being guided by the guides 8*a* and 8*b*.

The drum 3 has a cylindrical shape, and includes a retention mechanism retaining a sheet which has been conveyed by the conveyor mechanism 2*a*, by suction on the surface of the drum 3. As the retention mechanism, it is possible to employ a mechanism of air suction type, static electricity type, or the like, for example. When the drum 3 is driven by a not-shown motor, a sheet, which is held on the curved surface of the drum 3 by the retention mechanism (i.e., a sheet kept in a curved state), is conveyed between the drum 3 and the four heads 1.

The conveyor mechanism 2*b* includes: two cylindrical second conveyance rollers 7*a* and 7*b* facing each other with the conveyance path 10 interposed therebetween; and two guides 9*a* and 9*b* which are provided between the second conveyance rollers 7*a* and 7*b* and the drum 3 to guide a sheet. As the second conveyance roller 7*b* is driven by a not-shown motor, a sheet which has been conveyed from the drum 3 while being guided by the guides 9*a* and 9*b* is discharged to the outside of the printer 100, while being gripped between the second conveyance rollers 7*a* and 7*b*.

Next, with reference to FIGS. 2 to 6, the heads 1 will be described in detail. Since the four heads 1 included in the printer 100 have the same structure, the following description deals with one head 1 only.

Figure 2:
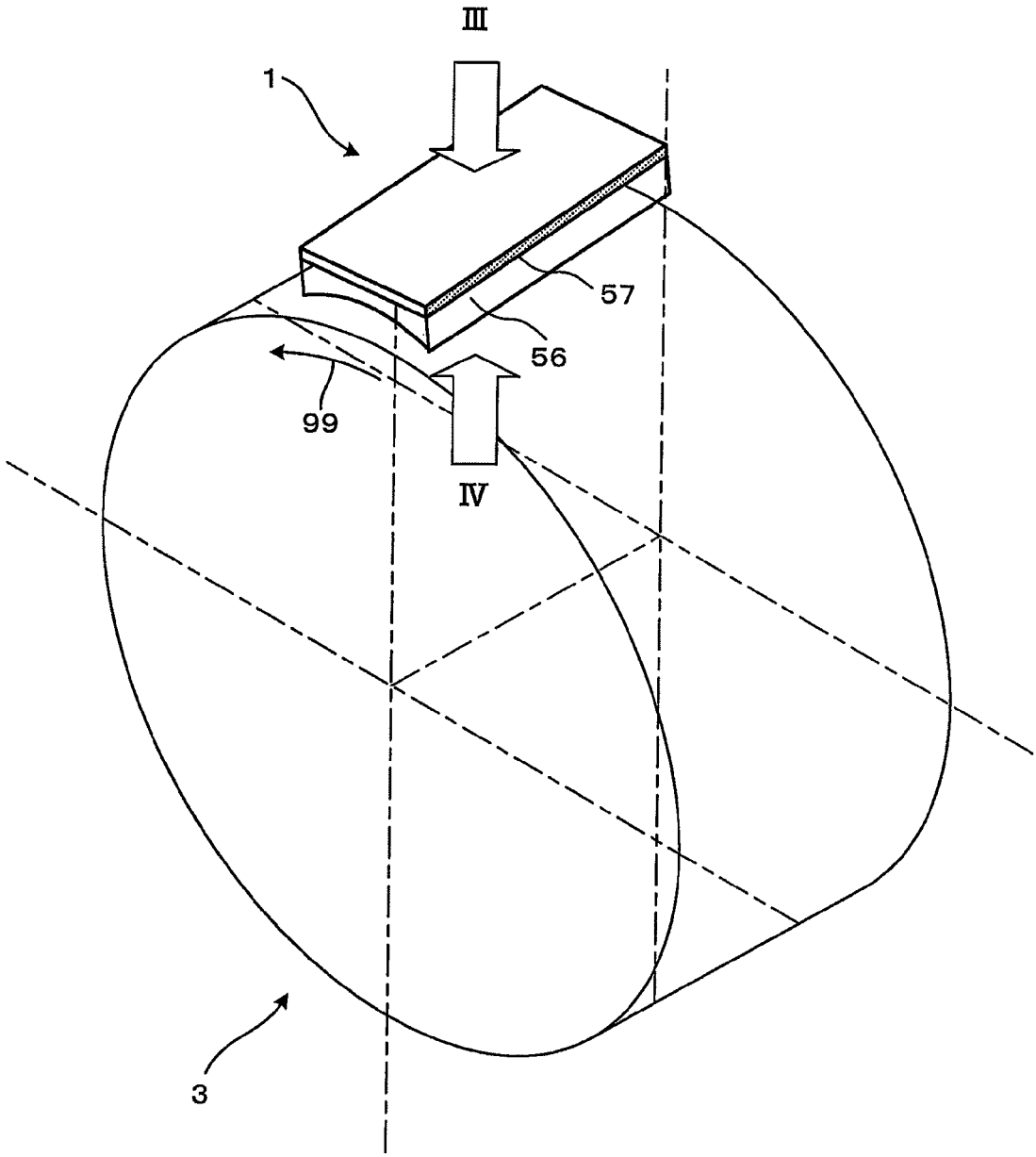
FIG. 2 is a perspective view illustrating a positional relation between one head included in the printer and a drum.

As shown in FIG. 2, the head 1 includes: a passage unit 56 having an ink passage formed therein; and a piezoelectric actuator 57 placed on an upper surface of the passage unit 56.

Figure 5:
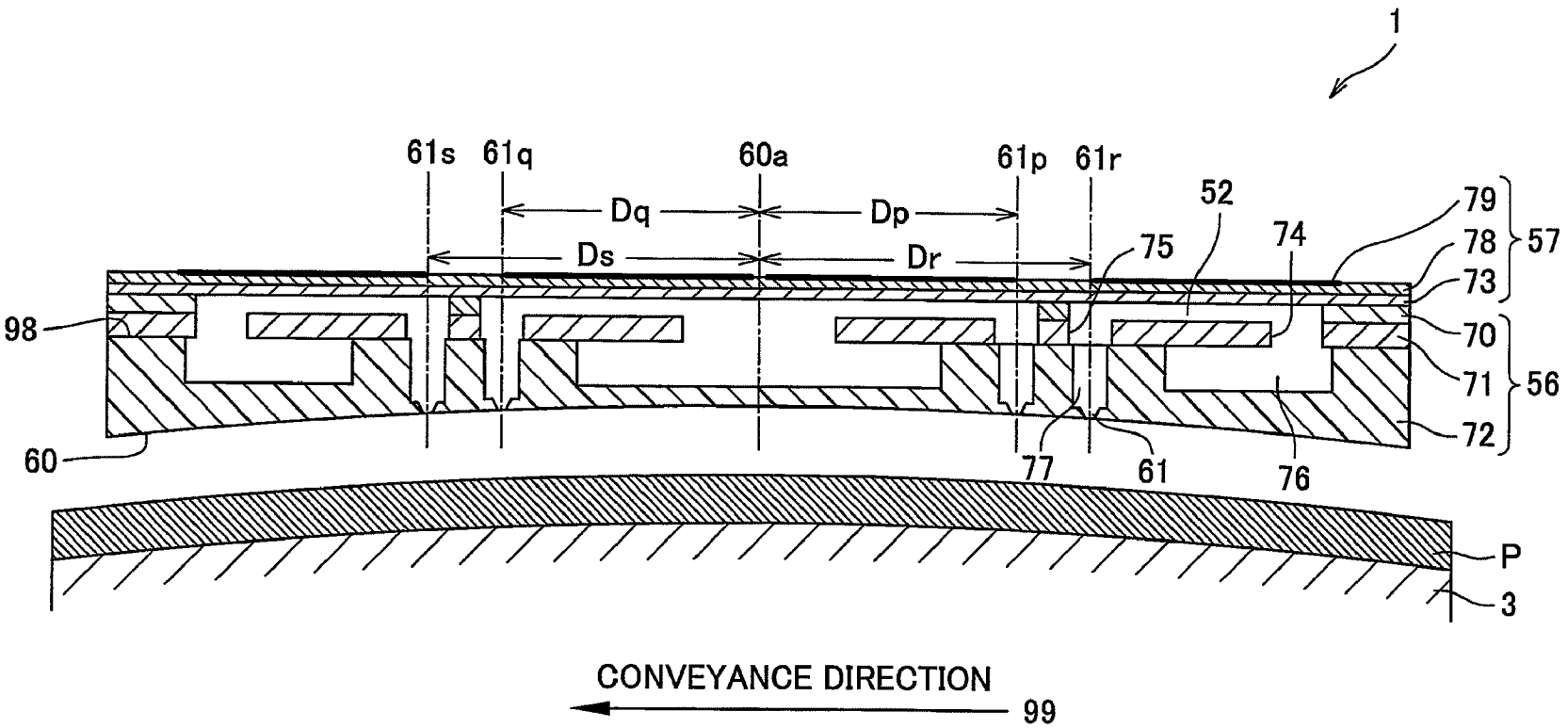
FIG. 5 is a sectional view of the head shown in FIGS. 3 and 4, taken along line V-V'.
Figure 6:
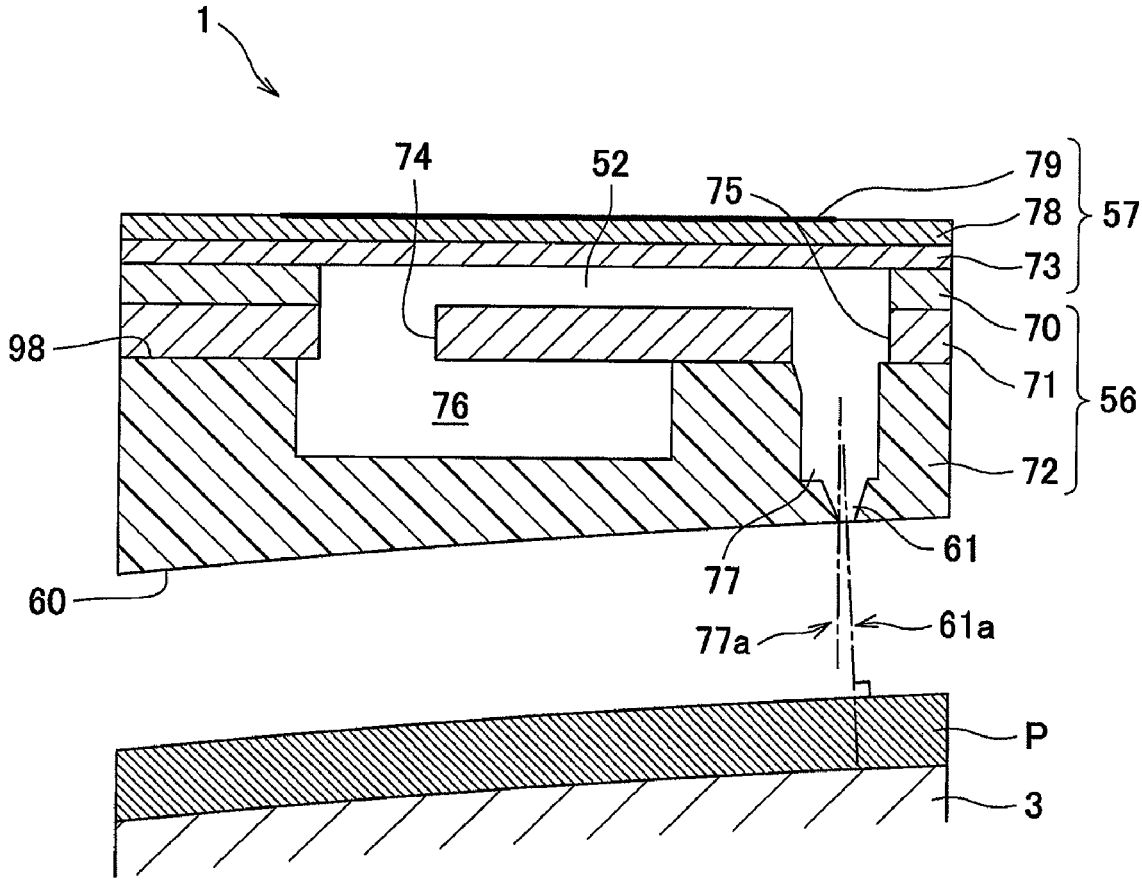
FIG. 6 is a partial enlarged view of FIG. 5.

As shown in FIGS. 5 and 6, the passage unit 56 has three plates: a cavity plate 70, a base plate 71, and a nozzle plate 72, which are stacked on top of one another and bonded to one another. The upper two plates 70 and 71 are made of stainless steel, and therefore the ink passage including pressure chambers 52 and communication holes 74 and 75 can be formed easily by etching. The lowest nozzle plate 72 is made of synthetic resin material such as polyimide, and is attached to an under surface of the base plate 71.

As shown in FIGS. 5 and 6, the cavity plate 70 has a plurality of through holes penetrating the cavity plate 70 in a thickness direction thereof. The through holes respectively form pressure chambers 52. Each of the pressure chambers 52 is defined by: a wall defining one of the through holes of the cavity plate 70; a diaphragm 73 which is above the cavity plate 70 and covers the through holes; and the base plate 71.

Figure 3:
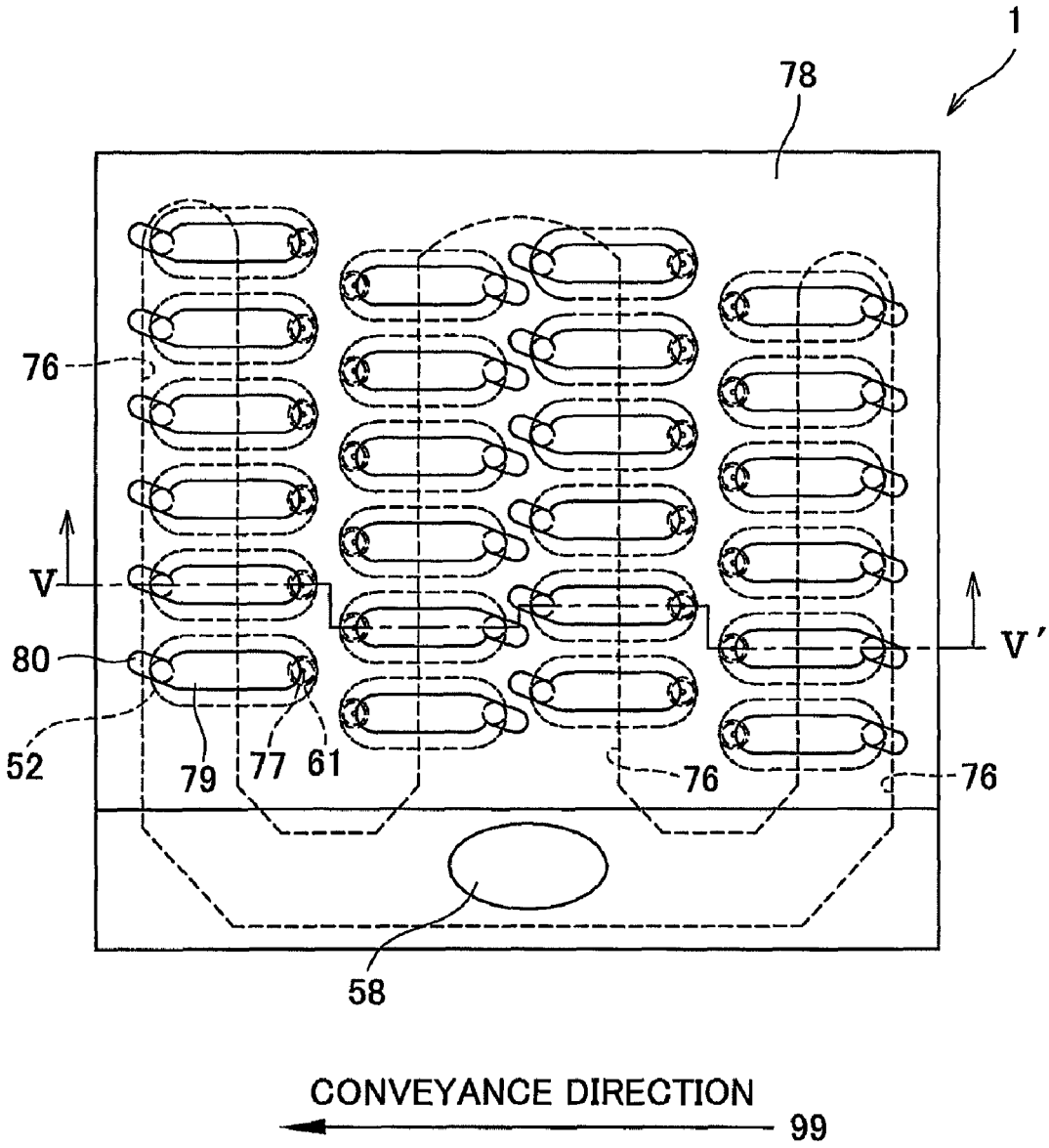
FIG. 3 is a plan view of the head shown in FIG. 2, viewed from the direction of an arrow III.

As shown in FIG. 3, the pressure chambers 52 constitute four pressure chamber rows each extending in a direction orthogonal to a sheet conveyance direction 99, the rows arranged in the conveyance direction 99. Each pressure chamber 52 has a substantially elliptical shape, in a plan view, elongated in the conveyance direction 99.

As shown in FIGS. 5 and 6, the communication holes 74 and 75 are formed in the base plate 71 so that a pair of communication holes 74 and 75 respectively overlap both ends of each pressure chamber 52 in a plan view.

As shown in FIGS. 2, 5, and 6, an under surface of the nozzle plate 72, that is an ink droplet ejection surface 60 is curved along the conveyance direction 99 so as to correspond to the curved surface of the drum 3. On the other hand, an upper surface of the nozzle plate 72, which is bonded to the base plate 71, is flat.

Figure 4:
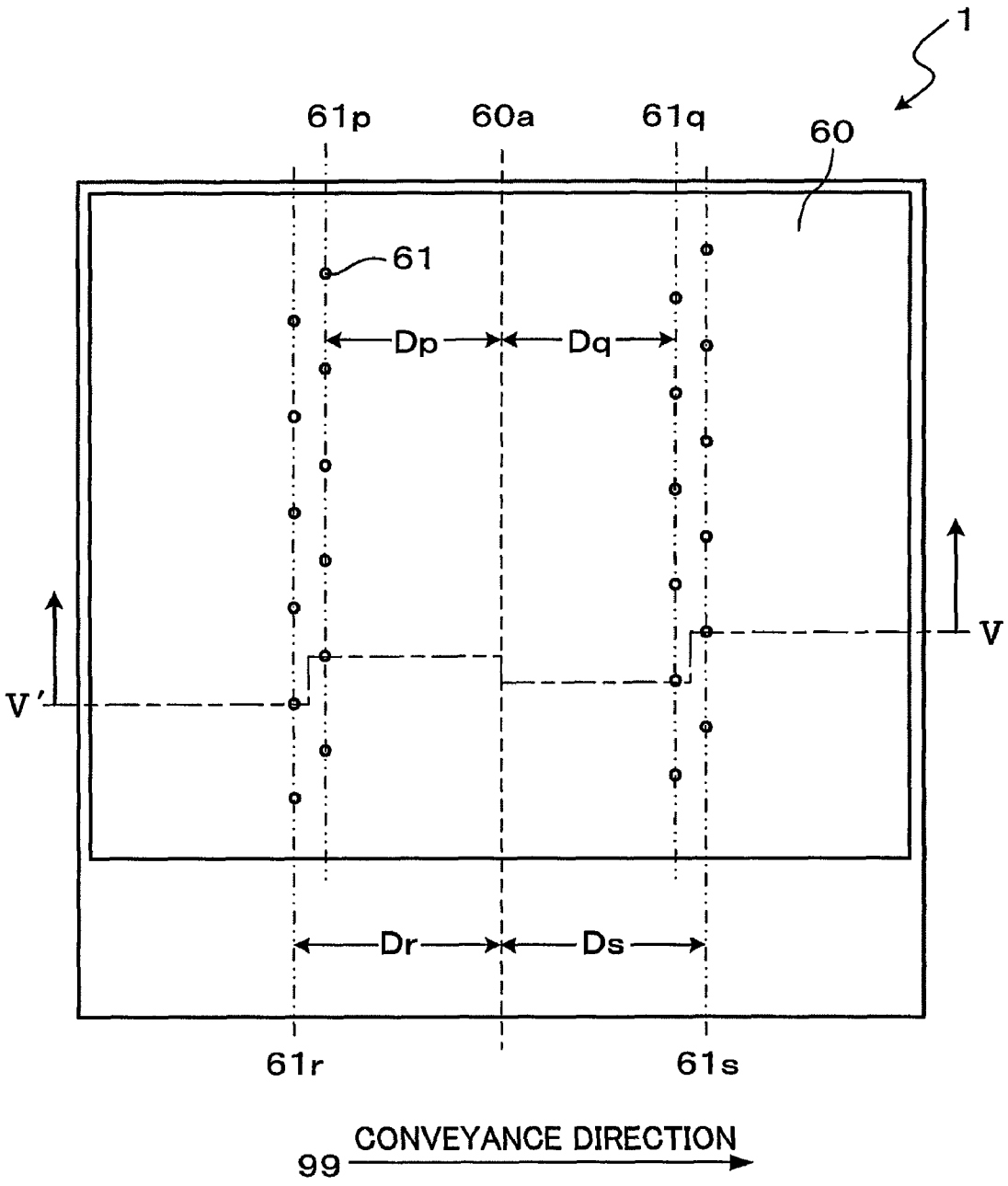
FIG. 4 is a plan view of the head shown in FIG. 2, viewed from the direction of an arrow IV.

As shown in FIG. 4, in the nozzle plate 72, a plurality of nozzles 61 respectively corresponding to the pressure chambers 52 are formed so that the nozzles 61 open on the ejection surface 60. Corresponding to the arrangement of the pressure chambers 52, the nozzles 61 constitute four nozzle rows 61*p*, 61*q*, 61*r*, and 61*s* each extending in the direction orthogonal to the conveyance direction 99, the rows arranged in the conveyance direction 99. Each of the nozzle rows 61*p* to 61*s* is formed of the same number of nozzles 61. The nozzles 61 included in each of the nozzle rows 61*p* to 61*s* are arranged at regular intervals in the direction orthogonal to the conveyance direction 99.

The nozzles 61, as well as the pressure chamber 52, are arranged in a matrix in a plan view.

As shown in FIG. 3, the nozzle plate 72 further includes three manifold channels 76 formed therein, each extending in the direction orthogonal to the conveyance direction 99. The manifold channels 76 communicate with the pressure chambers 52 via the respective communication holes 74 (see FIG. 5). Among the three manifold channels 76, a manifold channel 76 at the left in FIG. 3 communicates with the pressure chambers 52 of the leftmost pressure chamber row. A manifold channel 76 between two manifold channels communicates with the pressure chambers 52 of two pressure chamber rows between the leftmost and the rightmost pressure chamber rows. A manifold channel 76 at the right communicates with the pressure chambers 52 of the rightmost pressure chamber row. The manifold channels 76 supply ink to the pressure chambers 52 in communication therewith, respectively. The three manifold channels 76 communicate with a supply passage 58 (see FIG. 3) formed in the diaphragm 73. Through the supply passage 58, ink is supplied from a not-shown ink tank to the manifold channels 76.

Further, a plurality of descenders 77 are formed in the nozzle plate 72, corresponding to the nozzles 61. The descenders 77 connect the communication holes 75 and the nozzles 61, respectively. As shown in FIGS. 5 and 6, each of the descenders 77 extends from a corresponding one of the pressure chambers 52 and communication hole 75 to a corresponding one of the nozzles 61, along a direction in which the plates are stacked on top of one another.

The nozzle 61, which is a part of the ink passage formed in the passage unit 56, functions to determine an ejection direction and ejection speed of an ink droplet, and a size of ink droplet to be ejected. The descender 77 is a communication passage which establishes communication between a corresponding one of the pressure chambers 52 and a corresponding one of the nozzles 61. The length of the descender 77 affects AL (Acoustic Length) value, i.e., pressure wave propagation time for one-way propagation from an outlet of a manifold channel 76 to a nozzle 61 via a pressure chamber 52, associated therewith. Each of the descenders 77 in this embodiment extends along its axis 77*a* crossing a surface of the plate 70 on which the pressure chambers 52 extend. In addition a cross section of the descender 77 orthogonal to its extending direction is substantially constant in shape and size, from one end to the other end in the extending direction. Further, the descender 77 of this embodiment has a substantially cylindrical column shape and has the substantially same diameter from one end to the other end in its extending direction. Meanwhile, the nozzle 61 of this embodiment is configured so that: the nozzle 61 extends, from an end of a corresponding one of the descenders 77 farthest from a pressure chamber 52 toward the ejection surface 60, along its axis 61*a* crossing the plane on which the pressure chambers 52 extend; and the size of its cross section orthogonal to the axis 61*a* is gradually decreased toward one end of the nozzle 61. That is, the nozzle 61 of this embodiment has a shape of substantially truncated cone having an opening on the ejection surface 60 as a top thereof. The boundary between the nozzle 61 and the descender 77 is the end of the descender 77 farthest from the pressure chamber 52, which is a portion at which the size of the cross section orthogonal to an ink-flow direction starts to be decreased, discontinuously or continuously.

As shown in FIG. 6, the axis 61*a* of each nozzle 61 is inclined relative to the axis 77*a* of a corresponding one of the descenders 77, and orthogonal to the surface of the drum 3.

Thus, in the passage unit 56, there is formed the ink passage, starting from the manifold channels 76 each of which is common to multiple pressure chambers 52, branching into the pressure chambers 52, and then extending from the pressure chambers 52 to the respective nozzles 61 through the corresponding descenders 77.

The piezoelectric actuator 57 is for applying ejection pressure to ink in the pressure chambers 52. As shown in FIGS. 2 to 6, the piezoelectric actuator 57 has: the diaphragm 73 which is made of metal and disposed on the upper surface of the passage unit 56; a piezoelectric layer 78 formed on an upper surface of the diaphragm 73; and a plurality of individual electrodes 79 formed on an upper surface of the piezoelectric layer 78.

The diaphragm 73 is a conductive metallic plate and has a substantially quadrangular shape in a plan view. The diaphragm 73 covers the pressure chambers 52 formed in the cavity plate 70. The diaphragm 73 is always kept at ground potential, and functions as a common electrode which applies an electric field in a thickness direction to an active portion, which is a portion of the piezoelectric layer 78, sandwiched between the diaphragm 73 and an individual electrode 79.

The piezoelectric layer 78 mainly made of piezoelectric ceramic material such as lead zirconate titanate (PZT). The piezoelectric layer 78 has a plan-view shape similar to that of the diaphragm 73, and is disposed so as to extend over the plurality of pressure chambers 52, in a plan view.

As shown in FIGS. 3 and 6, each individual electrode 79 is disposed so as to overlap a corresponding one of the pressure chambers 52 in a plan view. Similarly to the pressure chambers 52, the individual electrode 79 has a substantially elliptical shape, in a plan view, elongated in the conveyance direction 99. However, the individual electrode 79 is a little smaller in size than the pressure chamber 52. The individual electrode 79 is made of conductive material such as gold, copper, silver, palladium, platinum, titanium, or the like. The individual electrode 79 has a contact 80 (see FIG. 3) extended therefrom. The contacts 80 are respectively bonded to terminals of a not-shown flexible wiring member such as Flexible Printed Circuit (FPC). Through the wiring member, the contacts 80 are electrically connected to a not-shown driver IC which selectively supplies driving voltage to the individual electrodes 79.

Now, a brief description will be provided with regard to driving of the piezoelectric actuator 57 at the time of ink ejection. When driving voltage is selectively supplied from the driver IC to the individual electrodes 79, a difference occurs in potential between an individual electrode 79 to which the driving voltage is supplied and the diaphragm 73 kept at ground potential, and this creates an electric field in an active portion of the piezoelectric layer 78, in a thickness direction thereof. When a polarization direction of the piezoelectric layer 78 is same as the direction of the electric field, the active portion of the piezoelectric layer 78 is extended in the thickness direction which is the polarization direction, and contracted in its plane direction. Along with this contraction of the piezoelectric layer 78, the diaphragm 73 is deformed so as to protrude toward a corresponding one of the pressure chambers 52. This decreases the capacity of the pressure chamber 52 and applies pressure to ink in the pressure chamber 52, and thereby an ink droplet is ejected from a nozzle 61 communicating with the pressure chamber 52.

Next, a manufacturing method of the head 1 will be described. In this embodiment, (i) the nozzle plate 72 which acts as a first member and (ii) a stack of the base plate 71, the cavity plate 70, and the piezoelectric actuator 57, which acts as a second member, are produced independently from each other, and then these two members are bonded to each other. As a result, the head 1 is completed.

Here, a production process of the first member (nozzle plate 72) will be described. In this embodiment, the nozzle plate 72 is produced by injection molding. That is, liquid synthetic resin material is injected into a mold having a predetermined shape to be cured in the mold, and then the molded product is taken from the mold. The molded product has a curved surface which is curved corresponding to the surface of the drum 3 (see FIG. 1), and a flat surface which lies opposite to the curved surface, and has therein the ink passage including the manifold channels 76 and the descenders 77. Each descender 77 extends along a direction orthogonal to the flat surface, and this makes it is easier to take the molded product from the mold.

Then, on the curved surface of the molded product, the nozzles 61 are formed by laser processing so that the nozzles 61 respectively correspond to the descenders 77. This process converts the curved surface into the ejection surface 60 on which the nozzles 61 open. On the other hand, the flat surface opposite to the ejection surface 60 becomes a bonding surface 98 (see FIGS. 5 and 6). Thus, the production process of the first member (nozzle plate 72) is completed.

Description will be given on a production process of the second member (the stack of the base plate 71, the cavity plate 70, and the piezoelectric actuator 57).

First, holes constituting the ink passage, which includes the pressure chambers 52 and the communication holes 74 and 75, are formed in the cavity plate 70 and the base plate 71, by etching or the like. Then, the three metal plates 70, 71, and 73 (the cavity plate 70, the base plate 71, and the diaphragm 73) are stacked on top of one another and the stacked plates are bonded to one another. In this process, the three plates 70, 71, and 73 may be bonded by an adhesive. Alternatively, the three plates may be bonded using diffusion bonding, in which the stacked three plates 70, 71, and 73 are pressurized while being heated at a predetermined temperature (e.g., 1000° C.) or more.

Then, the piezoelectric layer 78 is formed on the upper surface of the diaphragm 73. The piezoelectric layer 78 may be formed by depositing piezoelectric material on the upper surface of the diaphragm 73, using aerosol deposition, sputtering, sol-gel process, CVD, or the like, for example. Alternatively, the piezoelectric layer 78 may be formed by attaching a piezoelectric sheet obtained through firing a green sheet to the diaphragm 73. Then, the individual electrodes 79 are formed on the upper surface of the piezoelectric layer 78 using screen printing, sputtering, vapor deposition, or the like. Thus, the production process of the second member is completed.

After the first member (nozzle plate 72) and the second member (the stack of the base plate 71, the cavity plate 70, and the piezoelectric actuator 57) are produced independently from each other through the above-described processes, these members are bonded to each other using an adhesive. At this time, the under surface of the base plate 71 is bonded to the bonding surface 98 of the nozzle plate 72, with a pressing force being applied to the first or second member in a direction orthogonal to the bonding surface 98.

The head 1 of this embodiment and the manufacturing method thereof, which have been described above, provide following advantageous effects.

As shown in FIG. 5, the ejection surface 60 is curved corresponding to the curved surface of the drum 3. This decreases a possibility that the distance between the ejection surface 60 and a sheet P held on the surface of the drum 3 is not constant. Therefore, it is possible to prevent a deviation of the landing position of an ink droplet ejected from a nozzle 61.

In addition, the bonding surface 98 of the nozzle plate 72, which lies opposite to the ejection surface 60, is flat. Accordingly, the second member (the stack of the base plate 71, the cavity plate 70, and the piezoelectric actuator 57) which is to be bonded to the bonding surface 98 does not have to be curved, and may remain flat. This makes it easy to produce the second member and to handle the second member in an assembling process. Furthermore, since the bonding surface 98 is flat, it is possible to apply a force to the bonding surface 98 uniformly compared to the case where the bonding surface 98 is curved. Accordingly, it is possible to achieve easy and reliable bonding between the first and second members. Particularly, insufficient bonding between the plate 71 and the plate 72 in the passage unit 56 having the ink passage formed therein may cause a problem such as a leakage of ink from a gap between the plates 71 and 72. Therefore, the present invention capable of realizing easy and reliable bonding is very effective.

In the process of bonding the first member (nozzle plate 72) and the second member (the stack of the base plate 71, the cavity plate 70, and the piezoelectric actuator 57) together, the second member is bonded to the bonding surface 98 by a pressing force in the direction orthogonal to the bonding surface 98. This makes it possible to apply the force to the bonding surface 98 uniformly, thereby achieving more reliable bonding between the first and second members.

The whole ejection surface 60 is curved and the distance between the ejection surface 60 and a sheet P in a direction orthogonal to the surface of the drum 3 is constant across the entire ejection surface 60. Therefore, across the entire ejection surface 60, air stream generating between the ejection surface 60 and the sheet P is stabilized, and the behavior of ink droplets ejected from the nozzles 61 is stabilized. This prevents a deviation of the landing position of an ink droplet more reliably.

As shown in FIG. 6, the axis 61*a* of the nozzle 61 is orthogonal to the surface of the drum 3. Because of this, ink is ejected from the nozzle 61 in the direction orthogonal to the surface of the drum 3. Therefore, a deviation of the landing position of an ink droplet is prevented more effectively, and high-quality printing is realized.

The piezoelectric actuator 57 includes: the individual electrodes 79, in which a crack or the like causes a problem if it appears; and the piezoelectric layer 78 made of relatively fragile piezoelectric material. The piezoelectric actuator 57 having this structure is included in the second member which has no need to be curved and may remain flat. Therefore, according to the head 1 of this embodiment, there is no need for the piezoelectric actuator 57 to be curved. This makes it easier to manufacture the piezoelectric actuator 57, and decreases a possibility that a crack appears in the piezoelectric layer 78 or the individual electrodes 79, and also a problem such as a break in wires is decreased, compared to the case where the piezoelectric actuator 57 is configured to be curved. For example, in the case where the piezoelectric layer 78 is formed by attaching a piezoelectric sheet obtained through firing a green sheet to the diaphragm 73, it is possible to easily and reliably attach the piezoelectric sheet since the diaphragm 73 is flat.

The pressure chambers 52 are arranged on a plane parallel to the bonding surface 98. This makes the ink passage in the passage unit 56 compact, resulting in downsizing of the whole passage unit 56.

While the ejection surface 60 is curved, the pressure chambers 52 are arranged on the plane parallel to the bonding surface 98. In this structure, when the descenders 77 extend along the direction orthogonal to the bonding surface 98, the length of each descender 77 in its extending direction differs depending on where a corresponding one of the nozzles 61 is positioned on the ejection surface 60. In this case, a period of time required for a pressure wave applied to ink in each pressure chamber 52 by the piezoelectric actuator 57 to propagate from the pressure chamber 52 to a corresponding one of the nozzles 61 is different from one another, and this causes a variation in ejection energy finally given to ink, among the nozzles 61. In addition, a variation is caused also in passage resistance among the descenders 77. Such a variation in ejection energy among the nozzles 61 or in passage resistance among the descenders 77 decreases print quality, because of the difference in ejection characteristics (the volume of an ink droplet to be ejected, ejection speed, and the like) among the nozzles 61.

Therefore, in this embodiment, as shown in FIGS. 4 and 5, the inner nozzle rows 61*p* and 61*q* out of the four nozzle rows 61*p* to 61*s* are arranged so that the nozzle rows 61*p* and 61*q* are symmetrical to each other with respect to an axis 60*a* of the ejection surface 60. In other words, a distance Dp between the axis 60*a* and the nozzle row 61*p* is equal to a distance Dq between the axis 60*a* and the nozzle row 61*q*. Similarly, the outer nozzle rows 61*r* and 61*s* are also arranged so that these rows are symmetrical to each other with respect to the axis 60*a*. In other words, a distance Dr between the axis 60*a* and the nozzle row 61*r* is equal to a distance Ds between the axis 60*a* and the nozzle row 61*s*. The axis 60*a* extends parallel to the ejection surface 60, and passes through a center of the nozzle plate 72. Because of this arrangement of the nozzles 61, in a pair of nozzle rows arranged symmetrical to each other with respect to the axis 60*a* (rows 61*p* and 61*q*, or rows 61*r* and 61*s*), the descenders 77 respectively communicating with the nozzles 61 of the pair of rows have the same length, as shown in FIG. 5. Therefore, it is possible to suppress the above variation in ejection energy among the nozzles 61 or in passage resistance among the descenders 77, thereby to avoid a decrease in print quality.

Since a pair of inner and outer nozzle rows adjacent to each other i.e., the rows 61*p* and 61*r*, or the rows 61*q* and 61*s* have the respective distances from axis 60*a* which are slightly different from each other, the length of each descender 77 corresponding to the inner nozzle row is slightly different from that corresponding to the outer nozzle row. However, as seen from FIG. 5, since the difference in distance from the axis 60*a* between the pair of rows close to each other, i.e., the rows 61*p* and 61*r*, or the rows 61*q* and 61*s*, is very small, the difference in the length of each descender 77 is also very small. Accordingly, this difference has little effect on print quality.

In the nozzle plate 72 made of resin, there are formed: not only the nozzles 61 but also the manifold channels 76 each communicating with multiple pressure chambers 52. Since resin is relatively soft, it is possible to easily form the relatively complicated ink passage including the nozzles 61 and the manifold channels 76, by injection molding or the like. In addition, the manifold channels 76 are defined by the nozzle plate 72 made of relatively soft resin, and this enhances an effect of damping pressure fluctuation in the manifold channels 76 and suppresses pressure waves from mutually propagating between adjacent pressure chambers 52 via the manifold channels 76, that is, suppresses fluid crosstalk.

It is possible to easily form the nozzles 61 with high accuracy by laser processing conducted on the nozzle plate 72 made of resin.

With reference to FIG. 7 and FIGS. 8A to 8E, the following describes a head 401 of an alternative embodiment of the present invention. Note that, the same components as in the above embodiment will be given the same reference numerals, and the description thereof will be omitted. The head 401 of the alternative embodiment has the same structure as the above-described head 1, except the features described below.

Figure 7:
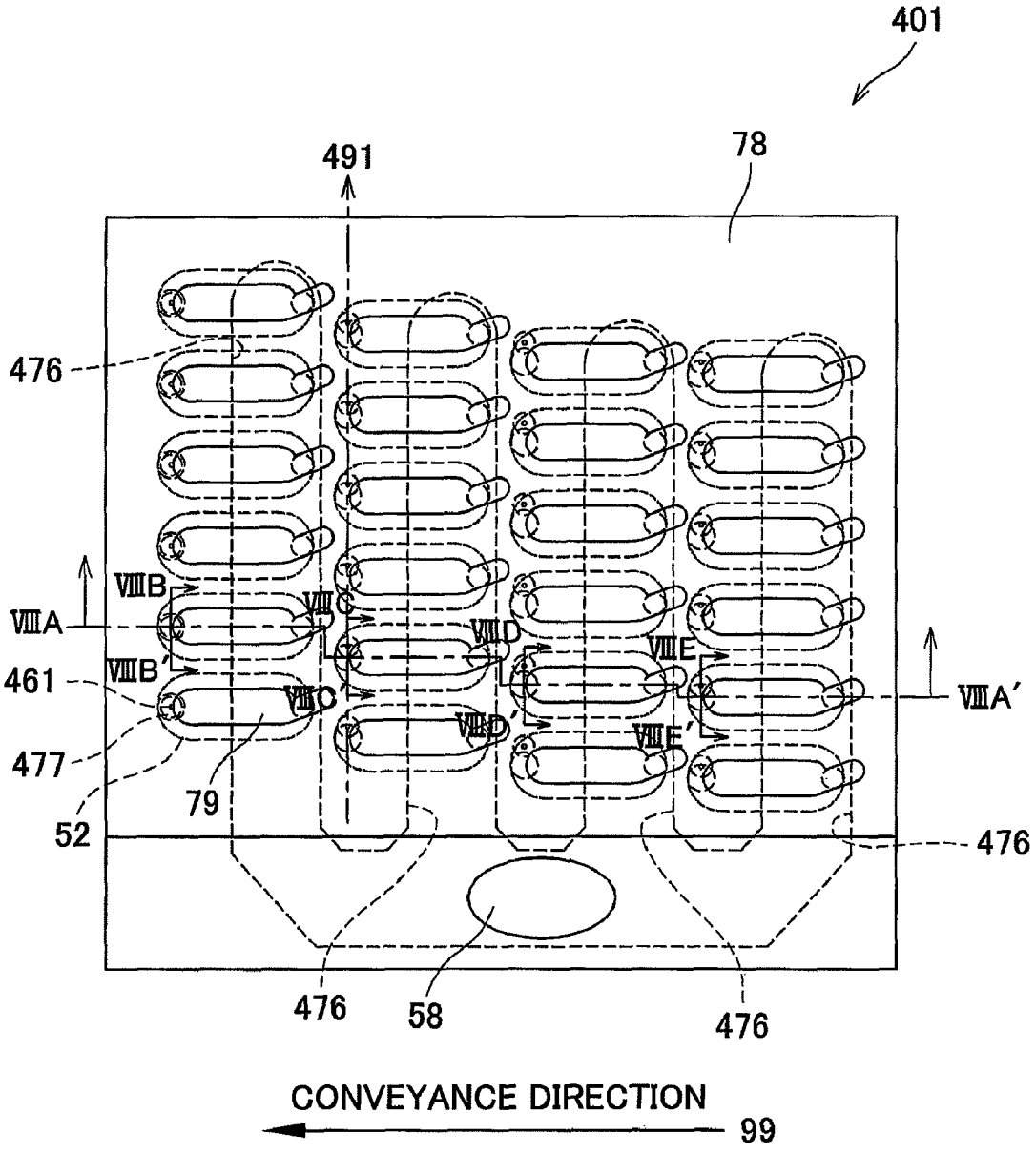
FIG. 7 is a plan view illustrating an ink-jet head of an alternative embodiment of the present invention.

In this alternative embodiment, as shown in FIG. 7, there are formed four manifold channels 476 each extending in a direction orthogonal to a conveyance direction 99. One manifold channel 476 corresponds to one pressure chamber row. Each manifold channel 476 communicates with pressure chambers 52 of a corresponding pressure chamber row via respective communication holes 74 (see FIG. 8A). One end of each pressure chamber 52 communicates with a corresponding nozzle 461, and the other end thereof communicates with a corresponding manifold channel 476.

As shown in FIGS. 8A to 8E, a passage unit 456 of the head 401 has three plates 70, 71, and 472 which are stacked on top of one another and bonded to one another. The nozzle plate 472 has an ejection surface 60 curved corresponding to a curved surface of a drum 3, similarly to the above-described nozzle plate 72.

As shown in FIG. 7, the nozzle plate 472 has the manifold channels 476 formed therein, each extending in the direction orthogonal to the conveyance direction 99. The manifold channels 476 communicate with a supply passage 58 formed in a diaphragm 73. Through the supply passage 58, ink is supplied from a not-shown ink tank to the manifold channels 476.

Further, as shown in FIGS. 8A to 8E, a plurality of descenders 477 which respectively connect communication holes 75 and the nozzles 461 are formed in the nozzle plate 472 so that the descenders 477 respectively correspond to the nozzles 461. Each descender 477 extends linearly from a corresponding one of the pressure chambers 52 to a corresponding one of the nozzles 461. Specifically, a descender 477 having a relatively long linear distance in a direction orthogonal to a bonding surface 98 from its pressure chamber 52 to the ejection surface 60 (a descender 477*b* at the leftmost in FIG. 8A) extends along the direction orthogonal to the bonding surface 98 (see FIG. 8B). On the other hand, a descender 477 having a relatively short linear distance in the direction orthogonal to the bonding surface 98 from its pressure chamber 52 to the ejection surface 60 (each descender other than the leftmost descender in FIG. 8A: descender 477*c*, 477*d*, 477*e*) extends along a direction inclined relative to the direction orthogonal to the bonding surface 98 (see FIG. 8C, 8D, 8E). The extending direction of each descender 477*c*, 477*d*, 477*e* is set depending on the above-defined linear distance thereof so that all the descenders 477 (477*b* to 477*e*) have the same length in their respective extending directions.

The above-described head 401 of this embodiment provides the following advantageous effects.

When the ejection surface 60 is curved and the pressure chambers 52 are disposed on a plane parallel to the bonding surface 98, the above-described problem may be caused, which is a variation in ejection energy among the nozzles 461 or in passage resistance among the descenders 477. This embodiment deals with this problem in the following manner. A part of the descenders 477, specifically, the descenders 477 each having a relatively short linear distance in the direction orthogonal to the bonding surface 98 from a corresponding one of the pressure chambers 52 to the ejection surface 60 (descenders other than the leftmost descender in FIG. 8A, i.e., the descenders 477*c*, 477*d*, and 477*e*) are configured to extend along a direction inclined relative to the direction orthogonal to the bonding surface 98 so that all the descenders 477 (477*b* to 477*e*) have the same length. This suppresses the variation in ejection energy among the nozzles 461 or in passage resistance among the descenders 477, and thereby a decrease in print quality can be avoided.

Figure 8A:
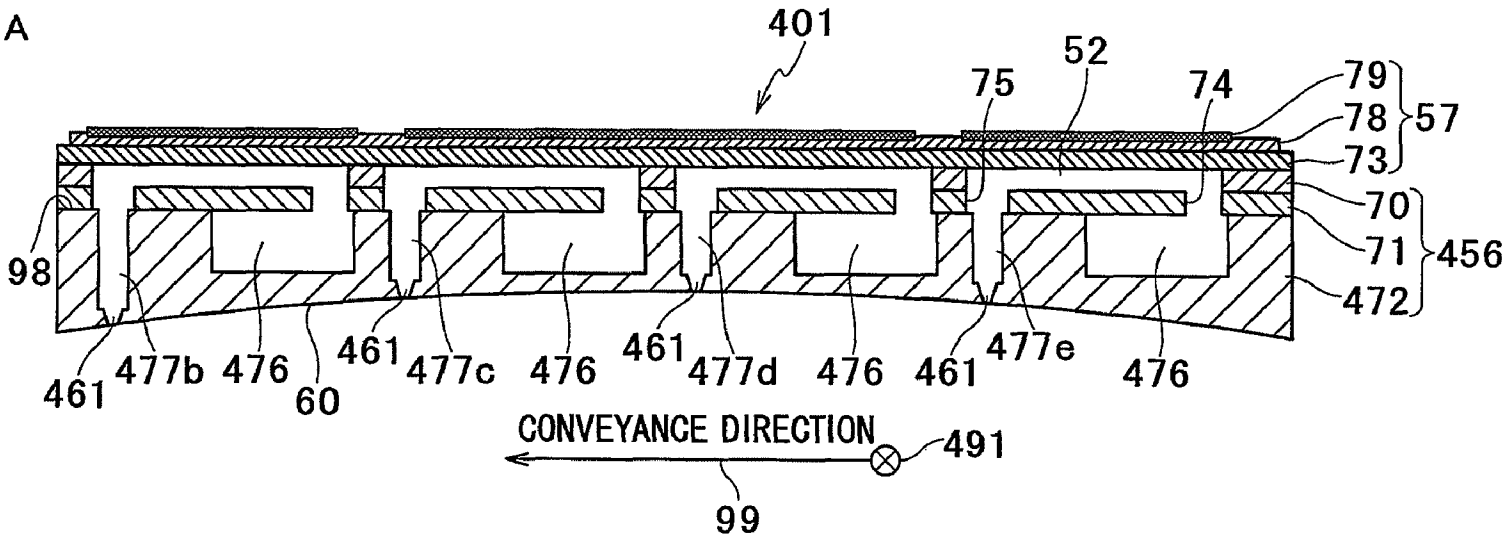
FIGS. 8A to 8E are sectional views of the head shown in FIG. 7, respectively taken along lines VIIIA-VIIIA', VIIIB-VIIIB', VIIIC-VIIIC', VIIID-VIIID', and VIIIE-VIIIE'.
Figures 8B, 8C, 8D, 8E:
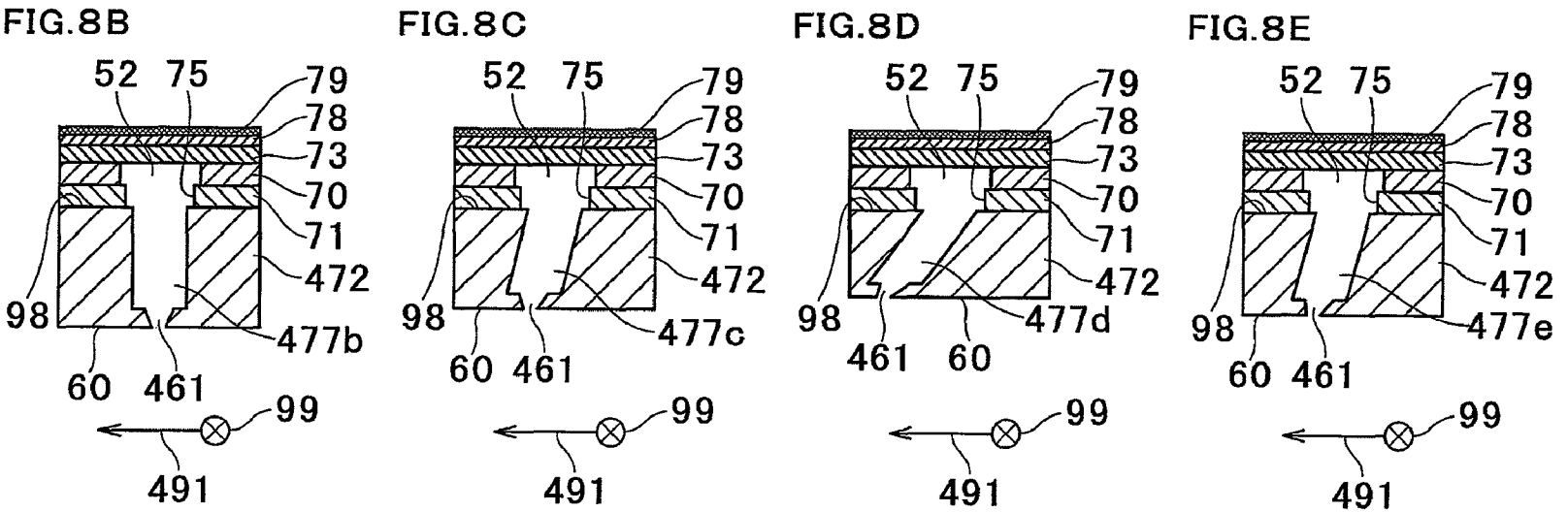

The extending directions of the descenders 477*c* to 477*e* shown in FIGS. 8C to 8E respectively, are inclined relative to the direction orthogonal to the bonding surface 98 toward an extending direction 491 of the pressure chamber rows (see FIGS. 7 and 8). As seen from FIG. 7, if the extending directions of the descenders 477*c* to 477*e* are inclined relative to the direction orthogonal to the bonding surface 98 toward the sheet conveyance direction 99, each of the descenders 477*c* to 477*e* occupies a larger area with regard to the conveyance direction 99 and it is required to lengthen intervals between rows of pressure chambers 52. As a result, the passage unit 456 becomes large in size in the conveyance direction 99. On the other hand, according to this embodiment, it is possible to avoid this large-size problem and to obtain the head 401 having a compact size in the conveyance direction 99.

It should be noted that the first member may be made of a material other than resin. When the first member is made of metal for example, injection molding is adoptable, and press working is usable to form the ink passage including the nozzles, in the production process of the first member.

Figure 9:
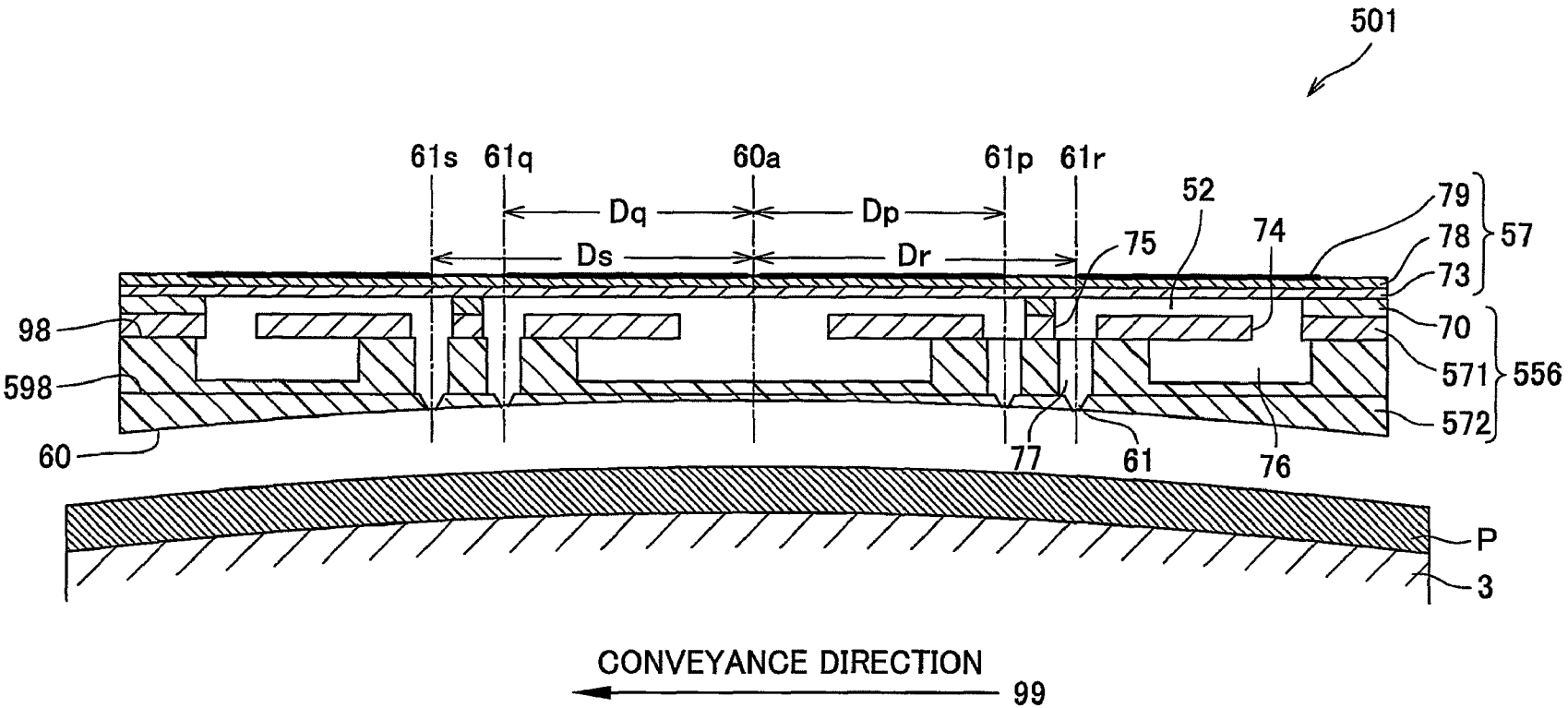
FIG. 9 is a sectional view illustrating an ink-jet head of one modification of the present invention, the view corresponding to FIG. 5.

Only the nozzles may be formed in the first member. For example, as a head 501 of one modification shown in FIG. 9, the nozzles 61 may be formed in a nozzle plate 572 functioning as the first member, and the manifold channels 76 and the descenders 77 may be formed in a plate 571 included in the second member. A passage unit 556 of the head 501 has four plates 70, 71, 571, and 572. The nozzle plate 572 has the curved ejection surface 60 and a flat bonding surface 598. The plate 571 is bonded to the bonding surface 598 of the nozzle plate 572.

Figure 10:
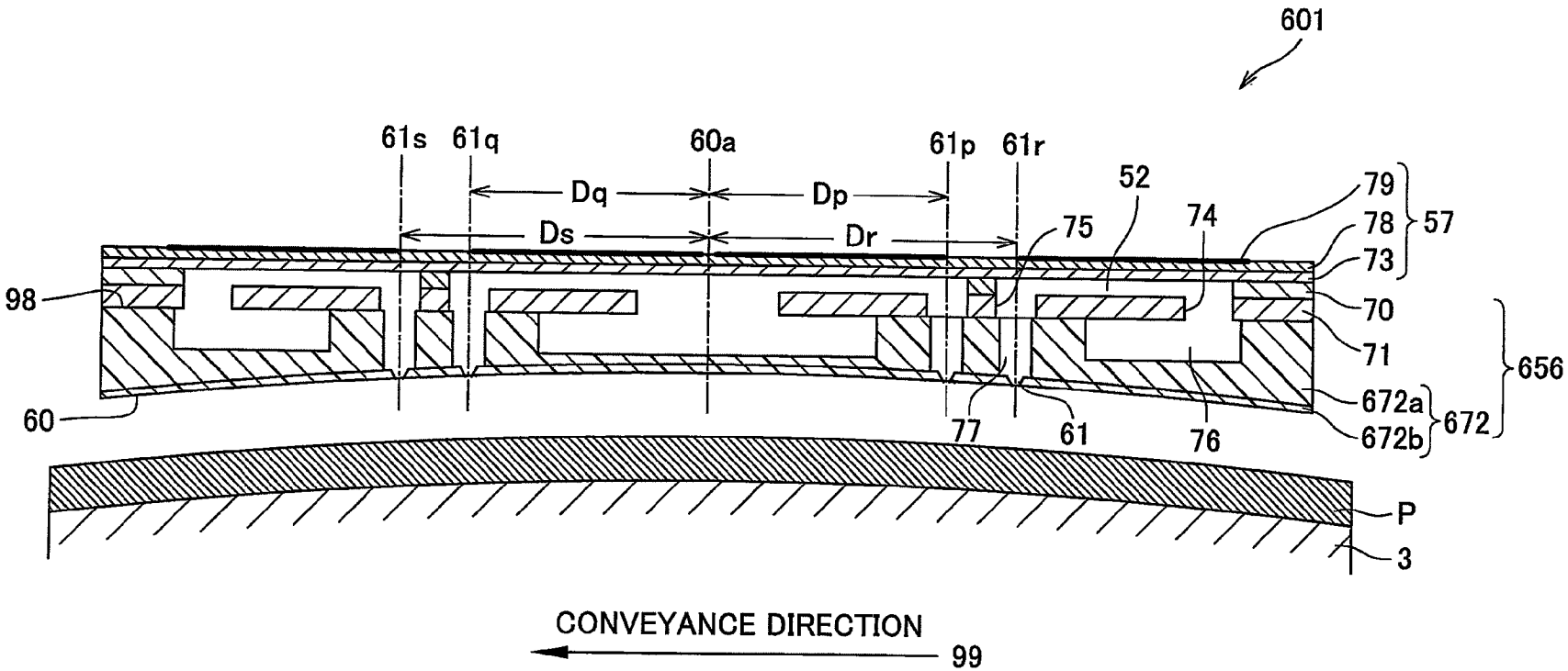
FIG. 10 is a sectional view illustrating an ink-jet head of another modification of the present invention, the view corresponding to FIG. 5.

The first member may include two or more components. For example, as a head 601 of another modification shown in FIG. 10, a nozzle plate 672 functioning as the first member may be a stack of a plate 672*a* and a film 672*b*. The plate 672*a* has the flat bonding surface 98 and an under surface curved in the same way as the ejection surface 60, and has the manifold channels 76 and the descenders 77 formed therein. The plate 672*a* may be made of metal such as stainless steel, for example. The film 672*b* has the curved ejection surface 60 and an upper surface curved in the same way as the ejection surface 60, and has nozzles 61 formed therein. The film 672*b* is made of synthetic resin material such as polyimide, for example. In this case, the nozzles 61 may be formed by laser processing after the film 672*b* is attached to the under surface of the plate 672*a*.

Alternatively, the first member may include therein, the entire ink passage formed in the passage unit, that is, the ink passage including manifold channels, pressure chambers, descenders, and nozzles. In this case, the second member is formed from a piezoelectric actuator only.

Each of the first and second members does not necessarily have to have a plurality of plates stacked on top of one another, and may be formed from a single component.

In the above-described embodiments, the piezoelectric actuator is included in the second member. However, the piezoelectric actuator does not have to be included in the second member. For example, such a configuration may be possible that the base plate 71 and the cavity plate 70 are stacked to form the second member, the stack of the plates 70 and 71 is bonded to the nozzle plate 72, and then the piezoelectric actuator is attached onto the plate 70.

The shape of the communication passage is not limited to the shape of the above-described descenders 77 or 477 and may be variously modified, as long as the communication passages establish communications between the pressure chambers and the nozzles, respectively.

The pressure applicator is not limited to a piezoelectric type of component, but may be of other various types. For example, the pressure applicator may apply ejection pressure to ink in a pressure chamber with the use of bubbling caused by providing thermal energy to the ink. Alternatively, the pressure applicator may apply ejection pressure to ink in a pressure chamber from a position separated from the passage unit.

The distance between the ejection surface of the first member and a sheet P does not have to be constant across the entire ejection surface, as long as at least two or more nozzles 61 opened on a part of the ejection surface have the same distance to a sheet P.

The droplet ejection device of the present invention is not limited to a line-type head, that is, a head which has nozzles formed on its droplet ejection surface so that the length of a nozzle row is not less than the width of a sheet P, and ejects ink onto a conveyed sheet P while remaining stationary at a predetermined position in an apparatus. The droplet ejection device of the present invention may be a so-called serial-type head which is a head ejecting ink droplets while reciprocating in a lateral direction of a sheet P. In addition, the droplet ejection device of the present invention is applicable not only to a color printer but also to a monochrome printer.

The droplet ejection device of the present invention may eject droplets onto various kinds of media other than a sheet P, as long as each medium has a curved surface. For example, the droplet ejection device may eject droplets to a cylindrical transfer drum. The transfer drum receives ink ejected from the head on the surface of the drum, and transfers the ink to a sheet being conveyed at a position different from that of the head. In addition, the droplet ejection device may eject droplets to a glass, plastic bottle, ball, nail or the like. Ejection of droplets to a nail is applicable to nail art.

The droplet ejection device of the present invention may eject droplets other than ink.

The application of the present invention is not limited to an ink-jet printer as is described in the above embodiments. However, the present invention is applicable to other various apparatuses, for example: an apparatus forming a fine wiring pattern on a substrate by ejecting conductive paste; an apparatus producing a high-definition display by ejecting organic light emitting materials onto a substrate; an apparatus producing a microelectronic device such as an optical waveguide by ejecting optical plastics onto a substrate; and the like.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. A droplet ejection device comprising:

a first member including a droplet ejection surface which has a plurality of nozzles opening thereon and a flat bonding surface which lies opposite to the droplet ejection surface, the droplet ejection surface being curved corresponding to a curved surface onto which the nozzles eject droplets;

a second member bonded to the bonding surface of the first member;

a plurality of pressure chambers arranged on a plane parallel to the bonding surface, each of the pressure chambers is configured to store liquid to which ejection pressure is applied; and a plurality of communication passages establishing communication between the pressure chambers and the nozzles, respectively, wherein:

each of the communication passages extends along a direction orthogonal to the bonding surface from a corresponding one of the pressure chambers to a corresponding one of the nozzles;

the nozzles comprise first and second nozzles, and openings of the second nozzles are arranged farther from an axis of the first member than openings of the first nozzles are arranged from the axis of the first member, wherein the axis extends in a direction orthogonal to the droplet ejection surface and passes though a center of the first member, and openings of two of the first nozzles and two of the second nozzles are arranged symmetrically, with respect to the axis, in a direction along a curving of the ejection surface; and the pressure chambers comprise first and second pressure chambers, wherein each of the first pressure chambers communicates with a corresponding one of the first nozzles and extends from a corresponding one of the first nozzles toward the axis in a direction parallel to the plane, and each of the second pressure chambers communicates with a corresponding one of the second nozzles and extends from a corresponding one of the second nozzles away from the axis in a direction parallel to the plane.

2. The droplet ejection device according to claim 1, wherein the droplet ejection surface has a shape such that a distance between the droplet ejection surface and the curved surface in a direction orthogonal to the curved surface is constant across the entire droplet ejection surface when the droplet ejection surface faces the curved surface.

3. The droplet ejection device according to claim 1, wherein the nozzles are formed so that respective axes of the nozzles are orthogonal to the curved surface when the droplet ejection surface faces the curved surface.

4. The droplet ejection device according to claim 1, wherein the second member is provided with a pressure applicator which applies ejection pressure to liquid in the pressure chambers.

5. The droplet ejection device according to claim 4, wherein a common liquid chamber communicating with the pressure chambers is formed in the first member.

6. The droplet ejection device according to claim 5, wherein the first member is made of resin.

7. The droplet ejection device according to claim 1, wherein the communication passages are formed in the first member.

8. A droplet ejection device comprising:

a first member including a droplet ejection surface which has a plurality of nozzles opening thereon and a flat bonding surface which lies opposite to the droplet ejection surface, the droplet ejection surface being curved corresponding to a curved surface onto which the nozzles eject droplets;

a second member bonded to the bonding surface of the first member;

a plurality of pressure chambers arranged on a plane parallel to the bonding surface, each of the pressure chambers is configured to store liquid to which ejection pressure is applied; and a plurality of communication passages establishing communications between the pressure chambers and the nozzles, respectively, wherein:

each of the communication passages extends linearly from a corresponding one of the pressure chambers to a corresponding one of the nozzles;

a part of the communication passages extends in an extending direction which is inclined relative to a direction orthogonal to the bonding surface; and all the communication passages have a same length in their respective extending directions and a same cross sectional area orthogonal to their respective extending directions.

9. The droplet ejection device according to claim 8, wherein:

the pressure chambers are arranged on the plane so that the pressure chambers constitute a pressure chamber row extending along a direction orthogonal to a direction in which a medium on the curved surface is moved relative to the droplet ejection surface; and the extending direction of the part of the communication passages is inclined relative to the direction orthogonal to the bonding surface toward an extending direction of the pressure chamber row.

* * * * *